US005458522A

United States Patent [19]

Brooks, III

[11] Patent Number: 5,458,522

[45] Date of Patent: Oct. 17, 1995

[54] FABRIC FASTENER BUILDING BLOCK

[76] Inventor: James A. Brooks, III, 409 Crockett La., Greeneville, Tenn. 37743

[21] Appl. No.: 238,623

[22] Filed: May 5, 1994

[51] Int. Cl.[6] ..... A63H 33/10

[52] U.S. Cl. ..... 446/85; 446/901

[58] Field of Search ..... 446/901, 85, 92, 446/120, 121, 124

[56] References Cited

U.S. PATENT DOCUMENTS 3,611,620 10/1971 Perry ..... 446/85 X

FOREIGN PATENT DOCUMENTS 1300206 12/1962 France ..... 446/901

2082925 3/1982 United Kingdom ..... 446/901

*Primary Examiner*—Mickey Yu

[57] ABSTRACT

A building block of any geometrical shape having fabric fasteners secured thereto for releasably coupling the block to another block. Each block includes a hollow geometrical shape with hook and loop material alternatingly positioned at opposed edges of the shape to facilitate securement of the block to another similarly constructed block. An alternate embodiment of the present invention includes blocks having either hook material or loop material exclusively with an indicator with each type of material present on the block. A further alternate embodiment provides a separation assembly positioned within the block and operable to facilitate a separation of attached blocks.

4 Claims, 4 Drawing Sheets

FIG. 3
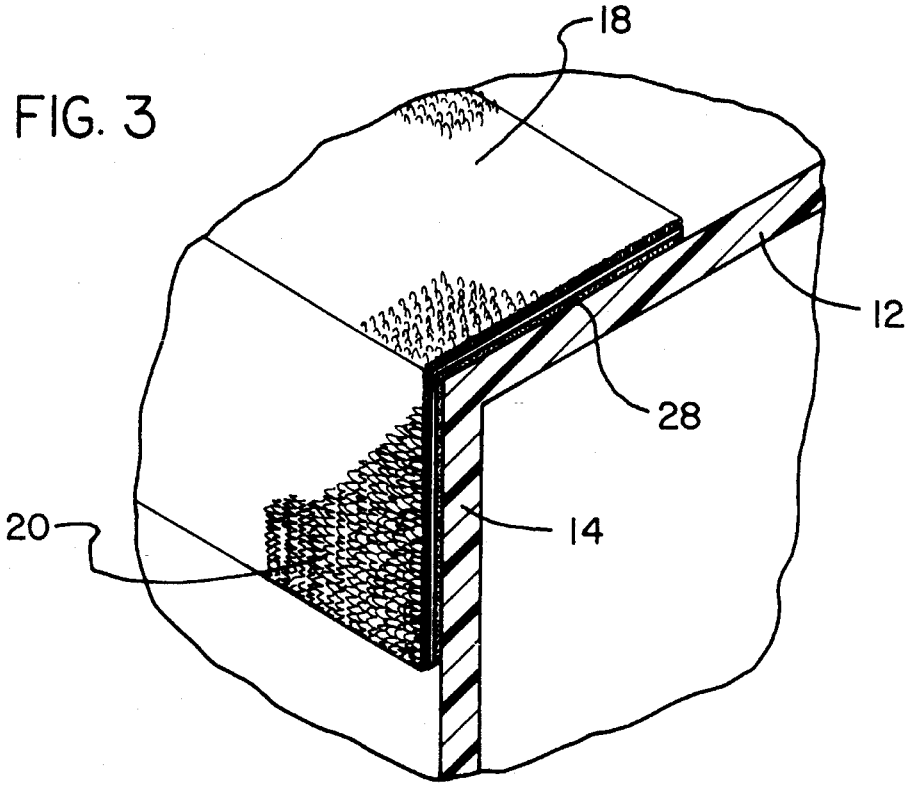
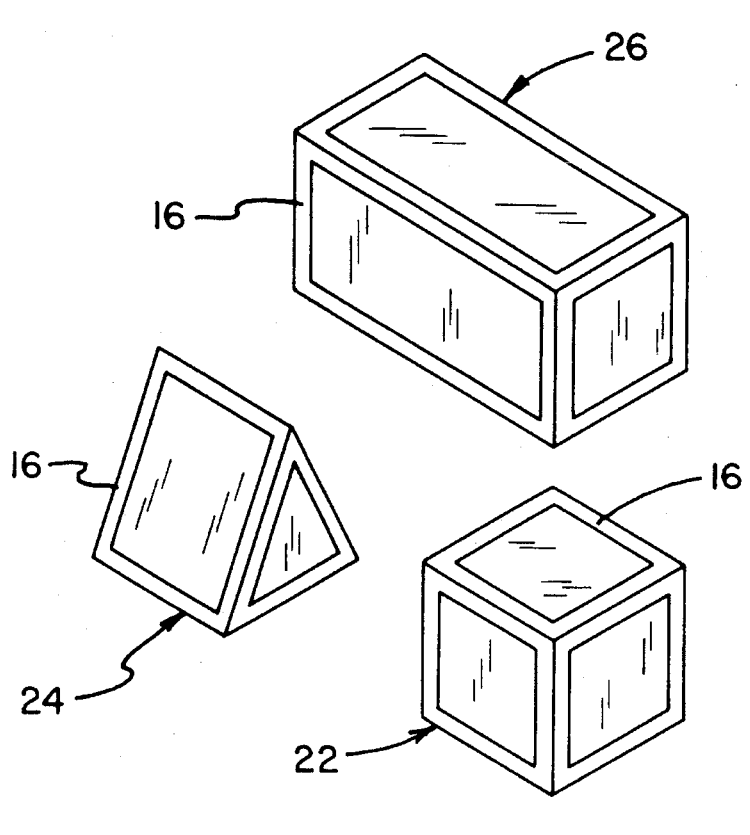
FIG. 4

FABRIC FASTENER BUILDING BLOCK

BACKGROUND OF THE INVENTION

1. Field of the Invention

The present invention relates to toy building blocks and more particularly pertains to a building block of any geometrical shape having fabric fasteners secured thereto for releasably coupling to another block.

2. Description of the Prior Art

The use of toy building blocks is known in the prior art. More specifically, toy building blocks heretofore devised and utilized for the purpose of constructing toy buildings and the like are known to consist basically of familiar, expected and obvious structural configurations, notwithstanding the myriad of designs encompassed by the crowded prior art which have been developed for the fulfillment of countless objectives and requirements.

For example, a toy building block is illustrated in U.S. Pat. No. 4,274,221 which takes the shape of a cube with two end-formed recesses, one at one corner of the cube, and the other in the diagonally opposed corner of the cube. The dimensions of both recess are equal and cubic, and equivalent to half the length of one of the sides of the cube.

A magnetic building block is disclosed in U.S. Pat. No. 5,021,021 which utilizes a metallic body and a magnetic strip extending around the periphery of the body. The magnetic strip is affixed to the metallic body such that the flat surfaces of the metallic body are aligned with the edges of the magnetic strip. The magnetic strip has multiple magnetic poles on the exterior surface to facilitate a securement of the magnet building block to a similarly constructed block in a number of positions.

Another patent of interest is U.S. Pat. No. 5,069,647 which describes a solid rectangular building block for a toy building set which is intended to interlock frictionally with like building blocks. Each building block has a plurality of intersecting grooves formed in its faces in a predetermined pattern and is also provided with a number of tongues extending outwardly from certain other faces which are intersected by the grooves and which are intended to fit into the grooves of similarly shaped blocks in a frictional relationship with such grooves, thereby securing the two blocks together.

While these devices fulfill their respective, particular objectives and requirements, the aforementioned patents do not describe a building block of any geometrical shape having fabric fasteners secured thereto for releasable coupling to another block which includes a hollow geometrical shape with hook and loop material alternatingly positioned at opposed edges of the shape to facilitate securement of the block to another similarly constructed block. Furthermore, none of the known prior art toy building blocks teach or suggest a separation assembly positioned within the block and operable to facilitate a separation of attached blocks.

In these respects, the fabric fastener building block according to the present invention substantially departs from the conventional concepts and designs of the prior art, and in so doing provides an apparatus primarily developed for the purpose of providing building blocks of any geometrical shape having fabric fasteners secured thereto for releasable coupling to another similarly constructed block.

SUMMARY OF THE INVENTION

In view of the foregoing disadvantages inherent in the known types of toy building blocks now present in the prior art, the present invention provides a new fabric fastener building block construction having fabric fasteners secured thereto which may be releasably coupled to another similarly constructed block. As such, the general purpose of the present invention, which will be described subsequently in greater detail, is to provide a new fabric fastener building block apparatus which has many of the advantages of the toy building blocks mentioned heretofore and many novel features that result in a fabric fastener building block which is not anticipated, rendered obvious, suggested, or even implied by any of the prior art toy building block, either alone or in any combination thereof.

To attain this, the present invention essentially comprises a building block of any geometrical shape having fabric fasteners secured thereto for releasably coupling the block to another block. Each block includes a hollow geometrical shape with hook and loop material alternatingly positioned at opposed edges of the shape to facilitate securement of the block to another similarly constructed block. An alternate embodiment of the present invention includes blocks having either hook material or loop material exclusively with an indicator with each type of material present on the block. A further alternate embodiment provides a separation assembly positioned within the block and operable to facilitate a separation of attached blocks.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fabric fastener building block apparatus which has many of the advantages of the toy building block mentioned heretofore and many novel features that result in a fabric fastener building block which is not anticipated, rendered obvious, suggested, or even implied by any of the prior art toy building block, either alone or in any combination thereof.

It is another object of the present invention to provide a new fabric fastener building block which may be easily and efficiently manufactured and marketed.

It is a further object of the present invention to provide a new fabric fastener building block which is of a durable and reliable construction.

An even further object of the present invention is to provide a new fabric fastener building block which is susceptible of a low cost of manufacture with regard to both materials and labor, and which accordingly is then susceptible of low prices of sale to the consuming public, thereby making such fabric fastener building blocks economically available to the buying public.

Still yet another object of the present invention is to provide a new fabric fastener building block which provides in the apparatuses and methods of the prior art some of the advantages thereof, while simultaneously overcoming some of the disadvantages normally associated therewith.

Still another object of the present invention is to provide a new fabric fastener building block of any geometrical shape having fabric fasteners secured thereto for releasable coupling to another similarly constructed block.

Yet another object of the present invention is to provide a new fabric fastener building block having hook and loop material alternatingly positioned at opposed edges of the block to facilitate a securement of the block to another similarly constructed block.

Even still another object of the present invention is to provide a new fabric fastener building block having either hook material or loop material exclusively and an indicator for each type of material positioned upon the block.

Even still yet another object of the present invention is to provide a new fabric fastener building block of any geometrical shape having fabric fasteners secured thereto for releasable coupling to another similarly constructed block which further includes a separation assembly positioned within the block and operable to facilitate a separation of attached blocks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an enlarged perspective view of the circled area of FIG. 2.

FIG. 4 is an even further perspective view of the present invention illustrating a few of the possible shapes provided by the present invention.

DESCRIPTION OF THE PREFERRED EMBODIMENTS

Figure 1:
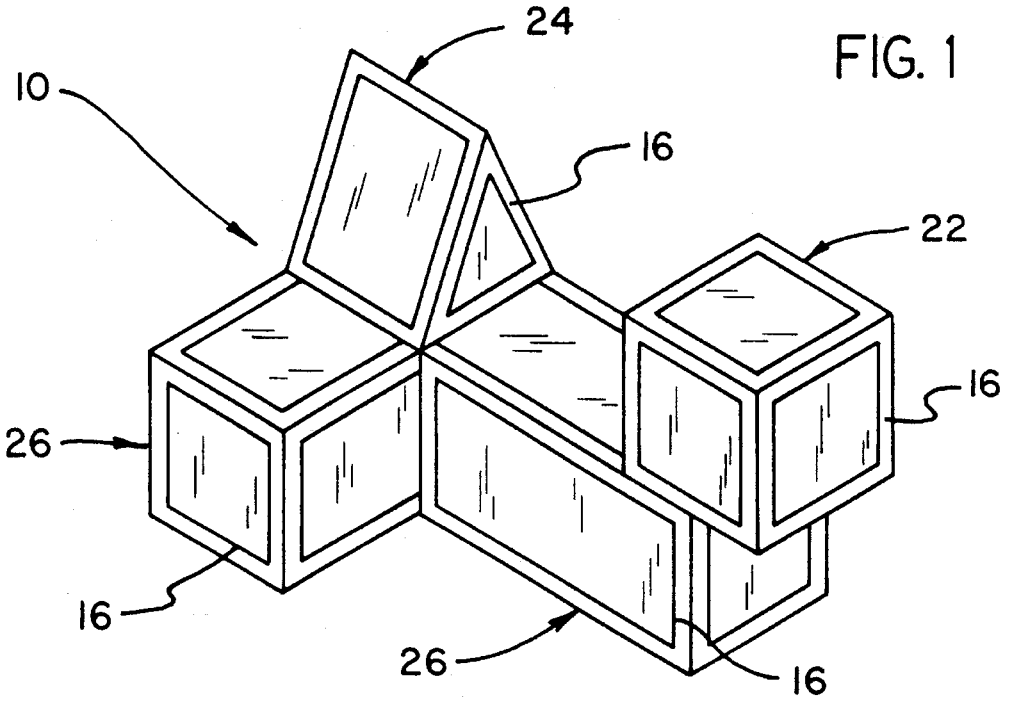
FIG. 1 is a perspective view of a first embodiment of a plurality of fabric fastener building blocks, each of which comprises the present invention.

With reference now to the drawings, and in particular to FIGS. 1–4 thereof, a first embodiment of a new fabric fastener building block embodying the principles and concepts of the present invention and generally designated by the reference numeral 10 will be described.

Figure 2:
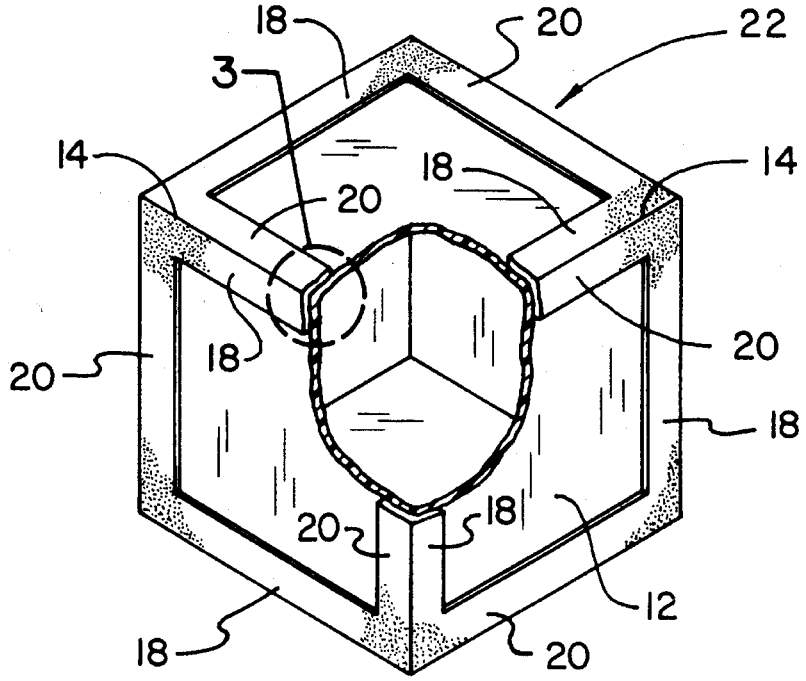
FIG. 2 is a further perspective view, partially in cross section, of the present invention.

The fabric fastener building block 10 comprises a hollow geometrical shape 12 having a plurality of edges 14 therearound. Positioned around such edges 14 is a fabric fastening material 16 which may be releasably coupled to similar fabric fastening material of another block 10. As best illustrated in FIG. 2, the fabric fastening material 16 comprises hook material 18 and loop material 20. Such hook and loop material is commonly sold under the trade name "VELCRO" and is well known.

The fabric fastener building block 10 may be provided in a variety of geometrical shapes such as a square block 22, a triangular block 24, or a rectangular block 26. Regardless of their shape, the building blocks 10 may be releasably coupled together in any conceivable arrangement, as illustrated for one such arrangement in FIG. 1.

More specifically, it will be noted that the fabric fastener building block 10 comprises a hollow geometrical shape 12 having any conceivable known geometrical shape and defining edges 14 therearound. Secured to such edges 14 is a fabric fastening material 16, commonly known as hook and pile material, hook and loop material, or "VELCRO". The fabric fastening material 16 is alternatingly positioned at opposed edges 14 of the geometrical shape 12, as best shown in FIG. 2. Close inspection of FIG. 2 reveals that each face of the geometrical shape 12 has hook material 18 at one pair of respectively opposed edges and loop material 20 at the other pair of respectively opposed edges of each face. In the case of other geometrical shapes which have a different or odd number of edges 14 along each face thereof, such as with the triangular block 24, the hook material 18 and the loop material 20 may be alternatingly positioned on each edge. More specifically, each of the edges 14 may be divided in half, whereby hook material 18 is positioned on one half of each edge and loop material 20 is positioned on the other half of each edge. This arrangement of hook and loop material 18, 20 allows the building block 10 to be positioned against a similarly constructed building block, whereby the engagement of the fabric fastener 16 of each block will occur to releasably secure the blocks together.

As mentioned before, the hollow geometrical shape 12 may take the form of any conceivable geometric shape and may also either be hollow or have a solid interior. FIG. 1 illustrates three of such possible shapes and it can be seen from this Figure that the hollow geometrical shape 12 may be formed into a square block 22, a triangular block 24, or a rectangular block 26. Other possible shapes include blocks having pentagonal, hexagonal, and octagonal cross sections.

FIG. 3 illustrates a securing means used to couple the fabric fastening material 16 to the geometrical shape 12. The securing means shown here utilizes an adhesive 28 applied to the edges 14 of the geometrical shape 12 to hold the hook material 18 and the loop material 20 in the positions described above. It is within the intent and purview of the instant invention to utilize other means of securing the fabric fastening material 16 to the geometrical shape 12, such as elastic bands, mechanical fasteners, and the like.

The fabric fastener building block 10 has been illustrated in this particular example as having fabric fasteners 16 positioned around the edges 14 of the hollow geometrical shape 12. It should noted that it is within the scope of the present invention to also include hollow geometrical shapes 12 in which fabric fastener 16 is positioned in any arrangement upon each face of the shape.

Figure 5:
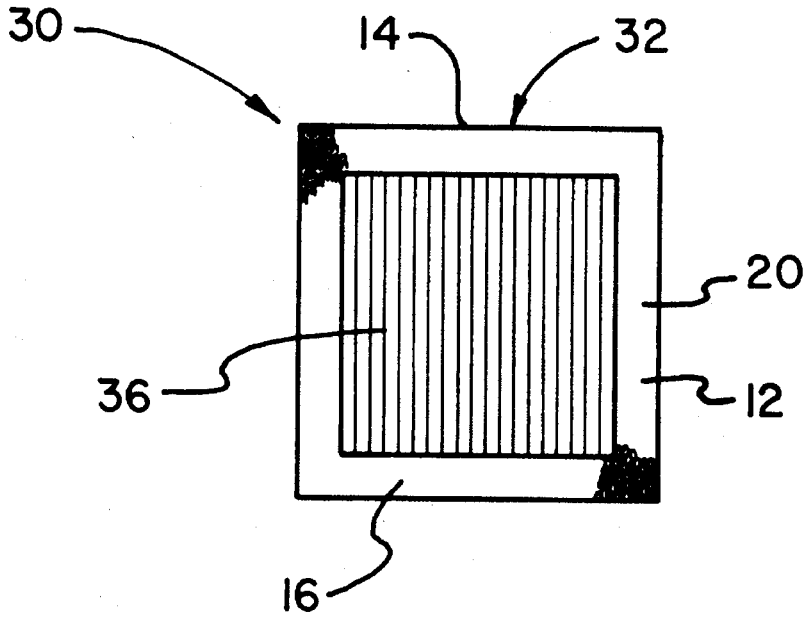
FIG. 5 is a top plan view of a second embodiment of a fabric fastener building block comprising the present invention.
Figure 6:
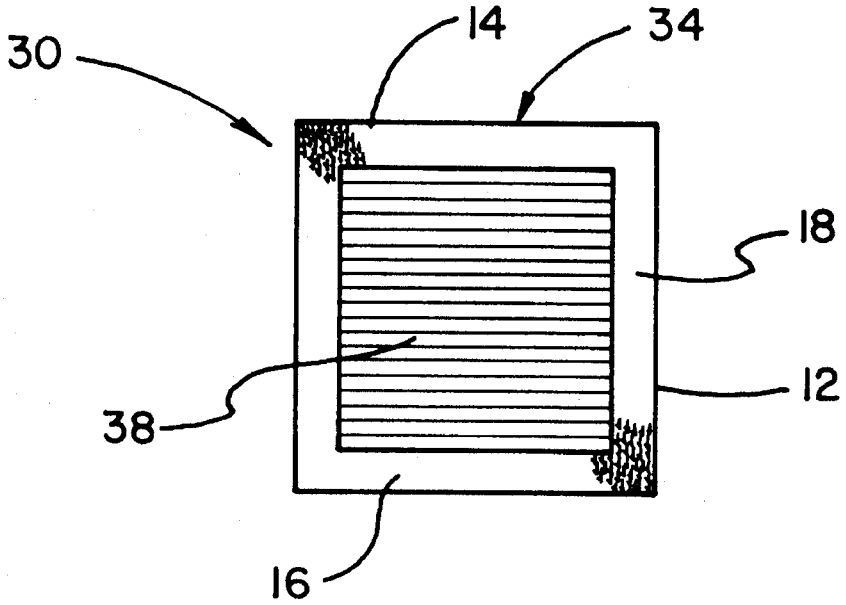
FIG. 6 is a top plan view of a further fabric fastener building block comprising a portion of the second embodiment.

A second embodiment of the present invention which comprises substantially all of the features of the foregoing embodiment 10, and which is generally designated by the reference numeral 30, can be seen in FIG. 5. The second embodiment 30 similarly comprises a hollow geometrical shape 12 having fabric fastening material 16 secured to edges 14 thereof. However, the second embodiment 30 is provided exclusively with either loop fastening material 20 to define a loop block 32, as illustrated in FIG. 5, or hook material 18 to define a hook block 34, as illustrated in FIG. 6. Because each of the blocks 32, 34 exclusively utilize only one of the types 18, 20 of fastening material 16, it is necessary to clearly identify each block in accordance with the type of fabric fastening material provided thereon.

To accomplish this, the loop lock 32 is provided with a loop indicator 36 positioned on at least one of the faces of the geometrical shape 12. Similarly, the hook block 34 is provided with a hook indicator 38 positioned anywhere on at least one of the faces of the geometrical shape 12. In the preferred embodiment, the loop indicator 36 comprises a red surface and the hook indicator 38 comprises a blue surface. It should be noted that other indicia may be utilized to create the loop indicator 36 and the hook indicator 38, such as words, symbols, or the like. In addition, any number of the faces of the geometrical shape 12 may be provided with such indicators 36, 38 to facilitate ready identification of the type of block being utilized.

Figure 7:
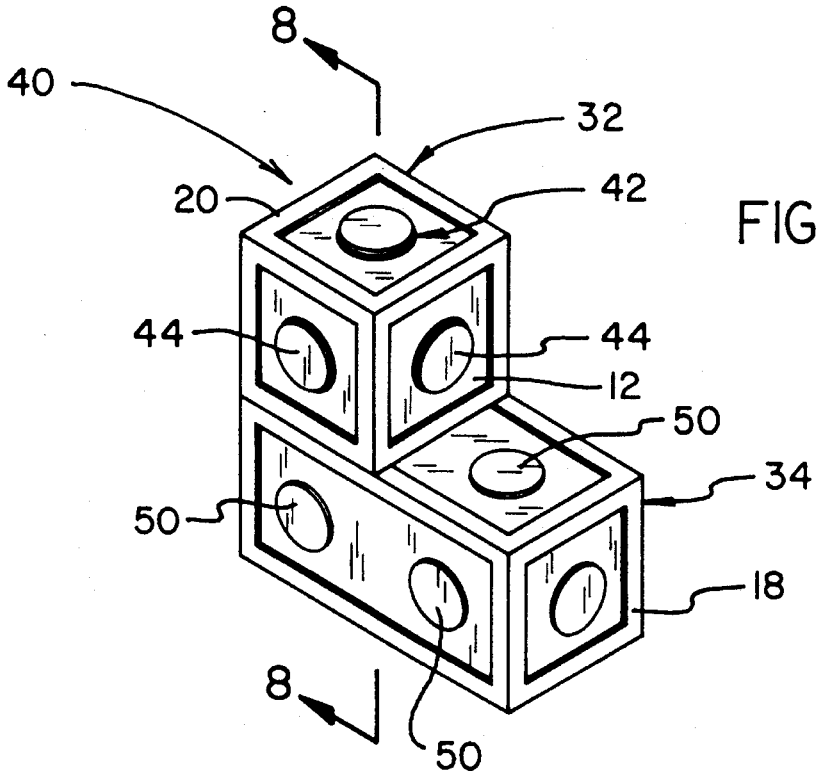
FIG. 7 is a perspective view of a third embodiment of a pair of fabric fastener building blocks comprising the present invention.
Figure 8:
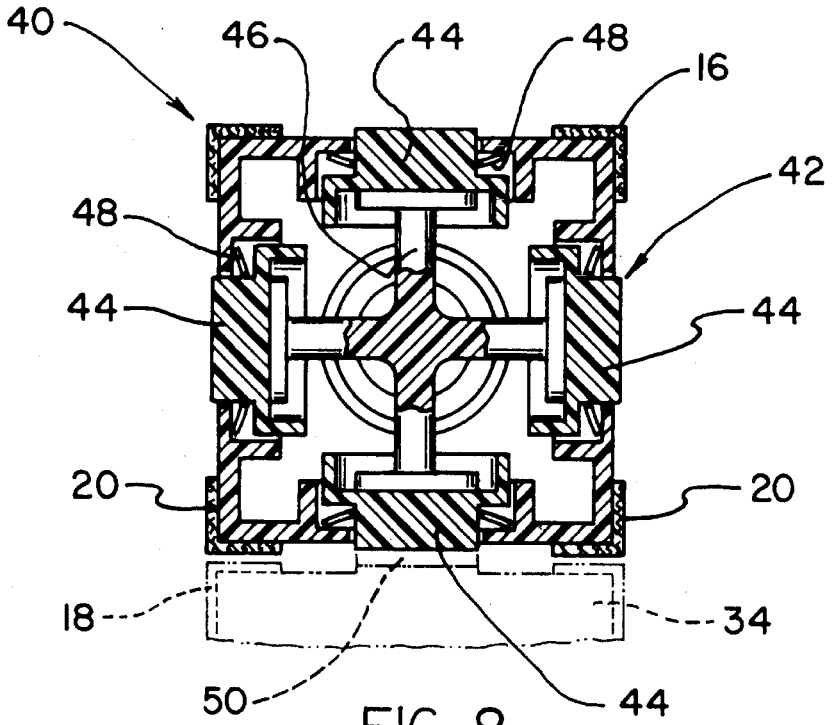
FIG. 8 is a cross sectional view taken along line 8-8 of FIG. 7.

Comprising substantially all of the features and structure of the previous embodiment 30, is a third embodiment which is generally designated by the reference numeral 40 and may be viewed in FIGS. 7–8. It can be shown that the third embodiment 40 similarly comprises a geometrical shape 12 having fabric fastening material 16 positioned around the edges 14 thereof. In accordance with the description of the second embodiment 30, the third embodiment 40 also includes a loop block 32 and a hook block 34 which exclusively utilize either loop material 20 or hook material 18, respectively. In addition, the third embodiment 40 further comprises a separation assembly 42 positioned within one of the blocks 40 which is operable to facilitate a separation of attached blocks.

The separation assembly 42 is best illustrated in FIG. 8 and it can be seen from this Figure that the separation assembly comprises a plurality of movable buttons 44, one of such buttons being positioned in a center area of each face of the geometrical shape 12. The movable buttons 44 are contained within the interior of the geometrical shape 12 and extend through unlabelled openings in each face thereof. The movable buttons 44 are supported by a push rod arrangement 46 which extends between respectively opposed buttons. A spring 48 biases each button 44 towards a center of the geometrical shape 12, as illustrated and labeled for two of such buttons in FIG. 8. By this structure, a depression of one of the movable buttons 44 will result in an extension of the respectively opposed movable button 44, thereby biasing the associated geometrical shape 12 away from a surface positioned proximate the extended button.

The hook block 34 is provided with a plurality of reaction surfaces 50 which are substantially similar in appearance to the movable buttons 44. However, the reaction surfaces 50 are integrally formed as a part of the geometrical shape 12, and will therefore, not move with respect to the shape. As best illustrated in FIG. 8, it can be seen that a depression of the upper most movable button 44 will cause an extension of the respectively opposed movable button which abuts one of the reaction surfaces 50 of the hook block 34 thereattached. This applied force effectively separates the loop material 20 of the loop block 32 from the hook material 18 of the hook block 34, thereby separating the attached blocks. Although the separation assembly 42 has been illustrated for a particular geometrical shape, it is to be understood that similar separation assemblies may be constructed for any conceivable geometric shape.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new fabric fastener building block comprising:

faces having an opening through each of said faces;

a plurality of movable buttons, each one of said buttons projecting through a respective one of said faces; and a push rod means coupled to said buttons for connecting said buttons together such that a depression of one button will result in an extension of another button.

2. The new fabric fastener building block of claim 1, and further comprising an indicating means positioned on at least one of said faces for indicating a type of fastening material coupled to said block.

3. The new fabric fastener building block of claim 2, wherein said indicating means comprises a red surface corresponding to loop material and a blue surface corresponding to hook material.

4. The new fabric fastener building block of claim 3, wherein said geometrical shape comprises a block selected from the group consisting of a square block, a rectangular block, and a triangular block.

* * * * *